United States Patent [19]

Hibari

[11] 4,352,980

[45] Oct. 5, 1982

[54] PAPER SHEET COUNTING MACHINE PROVIDED WITH SAFETY DEVICE

[75] Inventor: Eikoh Hibari, Tokyo, Japan

[73] Assignee: Laurel Bank Machine Co., Ltd., Tokyo, Japan

[21] Appl. No.: 140,974

[22] Filed: Apr. 17, 1980

[30] Foreign Application Priority Data

Apr. 20, 1979 [JP] Japan ..... 54/48595

[51] Int. Cl.[3] ..... G06M 9/02

[52] U.S. Cl. ..... 235/92 SB; 235/92 CA

[58] Field of Search ..... 235/92 SB, 92 CT, 92 FP, 235/92 MS, 92 CA, 92 PE, 98 R, 132 E; 340/550; 271/95, 103, 106

[56] References Cited

U.S. PATENT DOCUMENTS

| | | | |
|---|---|---|---|
| 4,064,391 | 12/1977 | Kokubo et al. | 235/92 SB |
| 4,227,074 | 10/1980 | Miyagawa | 235/92 SB |
| 4,239,204 | 12/1980 | Miyagawa et al. | 271/171 |
| 4,277,119 | 7/1981 | Shinyauchida | 312/208 |

*Primary Examiner*—Joseph M. Thesz
*Attorney, Agent, or Firm*—Fleit & Jacobson

[57] ABSTRACT

There is proposed a paper sheet counting machine provided with a safety device, the machine including a paper sheet counting mechanism and a double-leaf type sound-proof covers made movable between an open position to gain easy access to said counting mechanism and a closed position at which said sound-proof covers extend above the section containing said counting mechanism. The safety device is constructed such that the closing movements of the sound-proof covers are stopped if an obstacle is present adjacently or engaged with the edge faces of the sound-proof covers. The safety device comprises an obstacle detecting member and a control circuit responsive to a signal generated from said obstacle detecting member for generating a signal to stop the closing movements of the sound-proof covers, or alternatively it comprises a control circuit including a timer.

9 Claims, 8 Drawing Figures

PAPER SHEET COUNTING MACHINE PROVIDED WITH SAFETY DEVICE

BACKGROUND OF THE INVENTION

1. Field of the Invention

The present invention relates generally to a paper sheet counting machine, and more particularly to a safety device which is assembled with the sound-proof cover of the paper sheet counting machine.

2. Prior Art

The paper sheet counting machines disclosed in our co-pending patent applications Ser. Nos. 931,903, now U.S. Pat. No. 4,277,119 and 31,129, now U.S. Pat. No. 4,239,204, are provided with sound-proof covers operable to open or close the paper sheet counting sections in which paper sheets are held by a paper holder to be counted by means of rotary suction cylinders. These conventional paper sheet counting machines have sound-proof covers which can be closed to cover the paper sheet counting section during the counting operation by the counting mechanism including the holder for the bundle of paper sheets and the suction cylinders. The sound-proof covers can be opened as desired to gain access to the counting section for charging or discharging the bundle of paper sheets. After a bundle of paper sheets to be counted is put on the holder, a starting signal is generated to actuate the holder for shifting the bundle of paper sheet to the counting position and at the same time a motor for driving said sound-proof covers is actuated to close the covers. Alternatively, after the lapse of preset time interval from the time at which said starting signal for actuating the holder is generated, a delayed signal is delivered to said motor to start the closing operation of the sound-proof covers.

The paper sheet counting machine according to the preceding invention is advantageous in that the sound-proof covers are automatically closed simultaneously with or after a short interval from the commencement of the counting operation to shut out the noises and to ensure safety operation. However, this automatically operated sound-proof covers raise a problem that a hand or like part of the operator would be accidentally sandwiched in-between the covers. Although such an accident is not very dangerous to the operator, it is not preferred. In addition, the motor for driving the sound-proof covers is overloaded when an obstacle is sandwiched in-between the covers. Moreover, with the use of automatically driven sound-proof covers, the operator tends to pay his attention to the moving covers and is careless to place a bundle of paper sheet in position, leading to imprecise positioning of the bundle. As a result of such imprecise positioning, the number of paper sheets is erroneously counted.

SUMMARY AND OBJECT OF THE INVENTION

The present invention is accomplished to eliminate the disadvantages of the prior art counting machine as mentioned above.

The object of the present invention is to provide a safety device which is assembled with the sound-proof covers of the paper sheet counting machine and which is constructed so that the closing movements of the sound-proof covers are stopped if an obstacle, such as a portion of the operator's body or any other articles, is present adjacently or in the vicinity of the sound-proof covers. By the provision of such safety device, overloading of the motor for driving the sound-proof covers is precluded, and the operator is released from the fear of having his hand to be clamped between the sound-proof covers for long period of time so that he can pay his attention to inspect the disposed bundle of paper sheets for precluding erroneous counting. If the bundle is dislocated or any disorder is found during the closing operation, such dislocation or disorder may be immediately remedied by stopping the closing movements of the sound-proof covers simply by touching the edge face of the moving sound-proof covers by hand.

BRIEF DESCRIPTION OF THE DRAWINGS

The above and other objects and advantages of the present invention will become apparent from the following description taken in conjugation with the accompanying drawings, in which.

DESCRIPTION OF THE PREFERRED EMBODIMENTS

Figure 1:
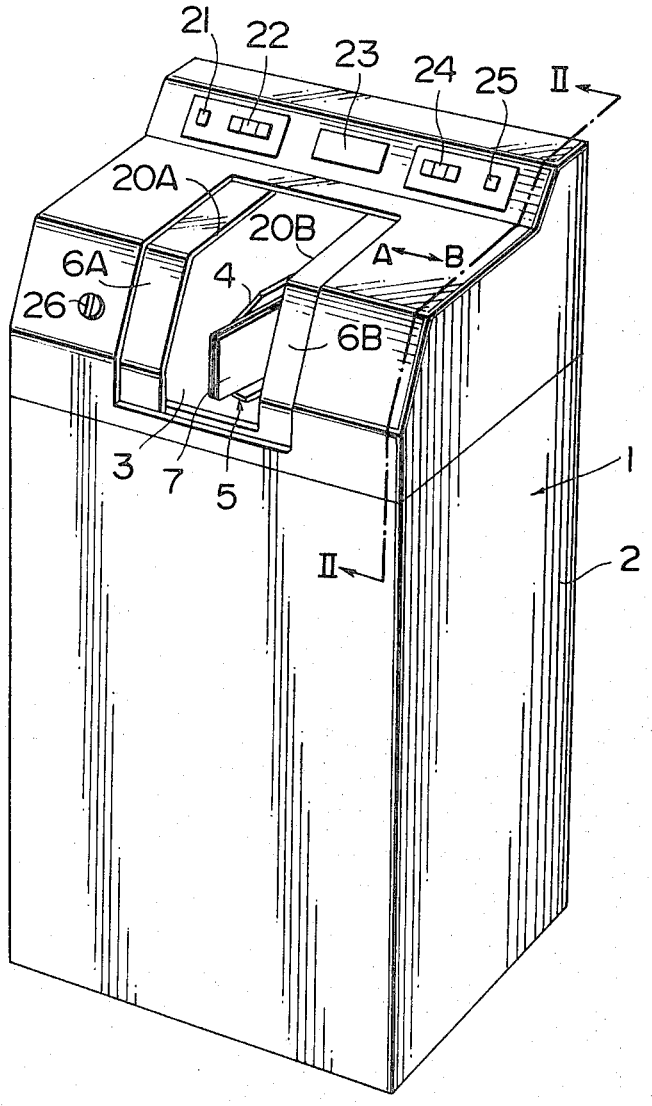
FIG. 1 is a perspective view diagrammatically showing the first embodiment of the paper sheet counting machine according to the invention.
Figure 2:
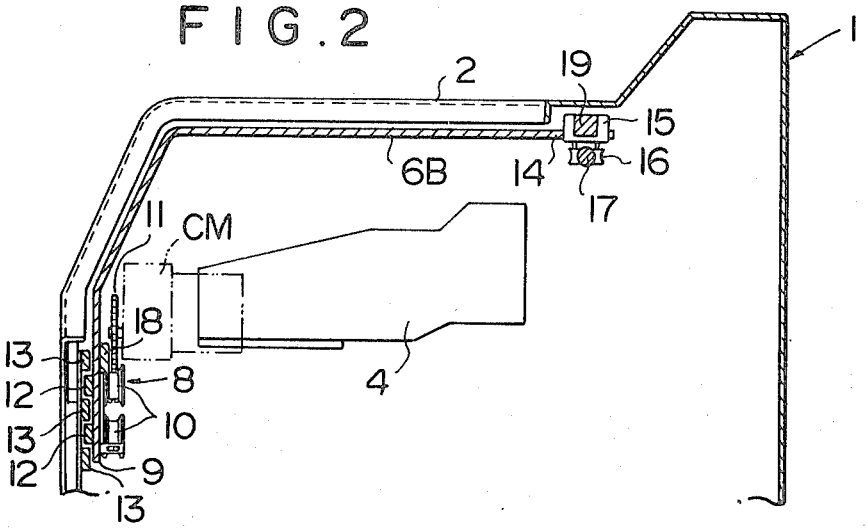
FIG. 2 is a sectional view of the first embodiment taken along line II—II in FIG. 1.
Figure 6:
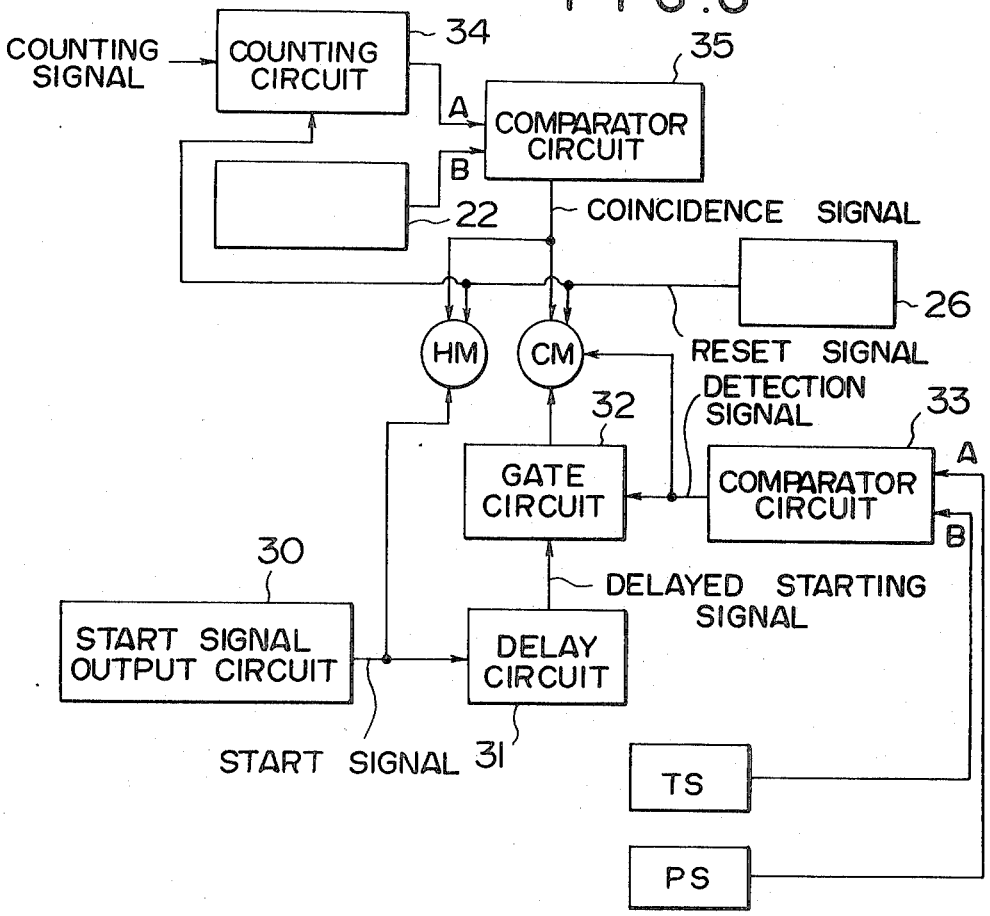
FIG. 6 is a block diagram showing the control circuit for controlling the sound-proof covers of the first embodiment according to the invention.

The preferred embodiments of the present invention will now be described with reference to the accompanying drawings. Referring first to FIGS. 1, 2 and 6, the construction and operation of the first embodiment according to the invention will be described. FIGS. 1 and 2 shows a paper sheet counting machine 1 having a machine frame 2 provided at an upper front portion with an alcove 3 in which a known counting mechanism 5 is disposed. The counting mechanism 5 may comprise a paper holder 4 and a plurality of suction cylinders (not shown), and the paper sheets held on the holder 4 are sucked and turned over one by the action of the suction cylinders to be counted. More detailed descriptions of the counting mechanism 5 will not be given herein, since it is considered superfluous to give such descriptions for those skilled in the art to understand the invention.

According to the present invention, a pair of sound-proof covers 6A and 6B are provided so as to move in the direction as shown by the arrow AB to cover or uncover the counting mechanism 5. The sound-proof covers 6A and 6B are controlled by a control circuit which will be described in detail hereinafter so that they begin to move toward each other when the counting mechanism 5 begins to count the paper sheets and finally they abut against each other to close the counting section within which the counting mechanism 5 is contained. When the counting operation is normally completed, the covers 6A and 6B begin to move from the closed position to the opened position, whereby a bundle 7 of the counted paper sheets may be taken out of the counting mechanism by hand. The holder 4 is driven by a holder motor HM (not shown), and the sound-proof covers 6A and 6B are driven by a cover motor CM.

The detailed construction of the driving mechanism 8 including the cover motor CM will now be described with reference to FIG. 2. A plurality of pulleys 10 are mounted on the inner side face of the lower end portion 9 of each sound-proof cover 6A and 6B. A chain (not shown) is stretched over these pulleys 10 and meshes with a sprocket 11 mounted on the shaft of the cover motor CM. On the outer side face of the lower end portion 9 fixed are slider blocks 12 which are guided by guide plates 13 attached on the interior of the machine frame 2 to engage with the slider blocks 12. On the upper end of each of the sound-proof covers 6A and 6B, there is mounted an attachment plate 15 provided with rollers 16 which rotatably fit on a guide bar 17 to be guided by the latter. By the provision of the driving mechanism 8 as described above, the sound-proof covers 6A and 6B are moved in the directions reverse to each other to open or close the alcove 3 when the cover motor CM is actuated. Reference numerals 18 and 19 designate permanent magnets. The permanent magnets 18 are fixed on the inner side face of respective sound-proof covers 6A and 6B at the vicinity of the lower end portion thereof having one ends flush with the edge faces 20A and 20B respectively of the sound-proof covers 6A and 6B. The permanent magnets 19 are buried in the respective attachment plates 15 mounted respectively on the upper ends of the sound-proof covers 6A and 6B so that the exposed edges of the magnets are flush with the edge faces 20A and 20B. When the sound-proof covers 6A and 6B are closed, the permanent magnets 18 and 19 attached to the sound-proof cover 6A attract the opposing permanent magnets 18 and 19 attached to the sound-proof cover 6B thereby to engage the edge face 20A with the edge face 20B more tightly, whereby the sound shut-out effect of the sound-proof covers can be improved.

Plates or films (not shown) of electrically conductive material are applied on said edge faces 20A and 20B over their entireties, the plate applied on the edge face 20A being connected to a power source of preset voltage and the plate applied on the other edge face 20B being grounded. A touch switch TS (FIG. 6) is formed by these plates. If a hand or finger of an operator is sandwiched in-between the sound-proof covers 6A and 6B which are moving to be closed, both plates are short-circuited electrically to switch on the said touch switch TS. This on-signal is transferred to said control circuit to stop the closing movements of the sound-proof covers 6A and 6B and then to reversely rotate the cover motor CM, whereby the sound-proof covers 6A and 6B are opened. The touch switch TS may be connected to either of DC and AC power sources.

Referring again to FIG. 1, on the front panel of the machine frame 2 above said counting mechanism 5, there are provided a main switch 21, digital switches 22 for presetting the number to be counted, a counted number display section 23, mode selection switches 24 and a cover switch 25. In FIG. 1, reference numeral 26 designates a reset switch of touch plate type. The cover switch 25 is a control switch for opening and closing the sound-proof covers 6A and 6B. When the cover switch 25 is on, said control circuit (see FIG. 6) is operative to control the opening and closing movements of the sound-proof covers 6A and 6B. On the contrary, when the cover switch 25 is off, said control circuit is not operative to move the sound-proof covers 6A and 6B so that they are retained at the opened positions.

Although not shown, a cover position sensor PS for sensing the complete closure of the sound-proof covers 6A and 6B is provided internally of the machine frame 2. The output signal from the cover position sensor is passed to the control circuit shown in FIG. 6.

Referring now to FIG. 6 descriptions will be made to the circuit arrangement of this embodiment including said control circuit for controlling the opening and closing movements of the sound-proof covers 6A and 6B. A start signal output circuit 30 detects a bundle 7 of paper sheets laid on the holder 4 to put out a starting signal. This start signal output circuit 30 may comprise, for example, a photo-sensor or a manually operated switch. The starting signal is delivered to a holder motor HM and a delay circuit 31, whereby the holder motor HM is rotated to move the bundle 7 of paper sheets to the counting position and the delay circuit generates a delayed starting signal which is delayed for a predetermined time period from said starting signal to deliver the delayed control signal to a gate circuit 32. A detected signal from a comparotor circuit 33 is put in the gate circuit 32, the input signals of the comparator circuit 33 being the output signals from the cover position sensor PS and the touch switch TC.

When the output signal from the cover position sensor PS is an off-signal from the touch switch TS is an on-signal, that is the case where a hand or like part of the operator is sandwiched in-between the sound-proof covers 6A and 6B, the comparator circuit 33 puts out an on-signal which is delivered to the gate circuit 32 and the cover motor CM, whereby the gate circuit 32 is rendered inoperative to prevent the delayed starting signal from said delay circuit 31 from passing therethrough to stop the closing movements of the sound-proof covers 6A and 6B and the cover motor CM is rotated in the reverse direction to begin to open the covers 6A and 6B. On the other hand, when both of the output signals from the cover position sensor PS and the touch switch TS are off-signals, i.e. the sound-proof covers 6A and 6B are closed under a normal operation condition, the comparator circuit 33 puts out an off-signal which is delivered to the gate circuit 32 and the cover motor CM, whereby the gate circuit is rendered operative to pass said delayed starting signal therethrough to the cover motor CM, so that the cover motor CM is rotated in the obverse direction to close the sound-proof covers 6A and 6B.

The counting signals put out from the counting mechanism 5 when the paper sheets are turned over one by one are put in a counting circuit 34 to be counted thereby. A signal showing the result of counting is put in a input terminal A of another comparator circuit 35. An output from the digital switches 22 showing the preset number of paper sheets to be counted is put in the other input terminal B of the comparator circuit 35. The comparator circuit 35 compares the input signals from these terminals to put out a coincidence signal when they are coincident with each other. The coincidence signal is delivered to the cover motor CM and the holder motor HM, whereby the cover motor CM begins to rotate in the reverse direction to open the sound-proof covers 6A and 6B and at the same time the holder motor HM begins to rotate to open the holder 4. The output signal from the reset switch 26 may be put in the cover motor CM, the holder motor HM and the counting circuit 34. If the counted number is not coincident with the preset number, the reset switch 26 is switched on to rotate the cover motor CM in the reverse direction thereby to open the sound-proof covers 6A and 6B and to rotate the holder motor HM thereby to open the holder 4, and the counting circuit 34 is reset to zero.

The operation of the first embodiment will be described. Prior to starting the counting operation, the digital switches 22 is operated, for example, to set the number at "100". The sheet number of "100" is thus preset by putting the signal showing "100" in the input terminal B of the comparator circuit 35. At this step, the cover switch 25 is switched on. Then, a bundle 7 of paper sheets is put on the holder 4, whereupon the bundle is sensed by sensing means, such as a photo-sensor, of the start signal output circuit 30 which generates a starting signal (on-signal). This starting signal is delivered to the holder motor HM and the delay circuit 31. Whereupon the holder motor HM begins to rotate to close the holder 4 and to move the bundle 7 of paper sheets to the counting position to be turned over by the suction cylinders. On the other hand, the starting signal delivered to the delay circuit 31 is delayed for a predetermined time (for example, for one second) to be put out as a delayed starting signal (on-signal) which is delivered to the gate circuit 32. At this stage, the output signal from the cover position sensor PS is an off-signal since the sound-proof covers 6A and 6B are not completely closed, and the output signal from the touch switch TS is also an off-signal provided that this touch switch TS is not touched by a hand or other obstacle. Under such circumstance, the detected signal from the comparator circuit 33 is an off-signal to allow the gate 32 operative to pass said delayed starting signal therethrough to the cover motor CM, whereby the cover motor CM begins to rotate in the obverse direction after it receives the delayed starting signal to move for closing the sound-proof covers 6A and 6B. If the touch switch TS is not switched on during the closing operation, the detected signal from the comparator circuit 33 is not changed to an on-signal so that the sound-proof covers 6A and 6B are closed normally. The counting signals put out responsive to the every turnover operations of the paper sheets are put in the counting circuit 34 to be counted. If the counted number at the completion of the counting operation is "100", a coincidence signal (on-signal) is put out from the comparator circuit 35 and delivered to the holder motor HM and the cover motor CM. As the result, both of the holder motor HM and the cover motor CM begin to rotate in the reverse direction to open the holder 4 and to open the sound-proof covers 6A and 6B. After the sound-proof covers 6A and 6B are completely opened, the bundle 7 of paper sheets is removed from the holder by the operator and the next counting cycle is repeated for counting the next bundle of paper sheets. On the contrary, if the counted number is not coincident with "100", the comparator circuit 35 does not generate a coincidence signal. As the result, both of the holder motor HM and the cover motor CM do not rotate in the reverse direction so that the holder 4 and the sound-proof covers 6A and 6B are retained at the closed positions. The holder 4 and the sound-proof covers 6A and 6B can be opened to remove the bundle 7 of paper sheets when the counting circuit 34 is reset by switching on the reset switch 26 to rotate the holder motor HM and the cover motor CM. If a hand or other part of the operator is sandwiched in-between the sound-proof covers 6A and 6B during the closing operation to switch on the touch switch TS, the detected signal from the comparator circuit 33 is changed to an on-signal to render the gate circuit inoperative to prevent the delayed starting signal from passing therethrough and at the same time the detected signal is delivered to the cover motor CM to rotate the cover motor CM in the reverse direction. As the result, the sound-proof covers 6A and 6B stop to close and then begin to open. When the operator's hand sandwiched in-between the covers is removed, the touch switch TS is changed over to the off condition so as to change the detected signal from the comparator circuit 33 again to an off-signal, whereby said delayed starting signal is allowed to pass through the gate circuit 32 to deliver to the cover motor CM. As the result, the cover motor CM begins to rotate again in the obverse direction to close the sound-proof covers 6A and 6B.

Figure 3:
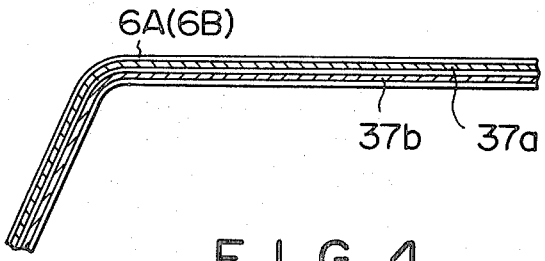
FIG. 3 is an end view showing the edge face of sound-proof cover used in the second embodiment of the invention.
Figure 7:
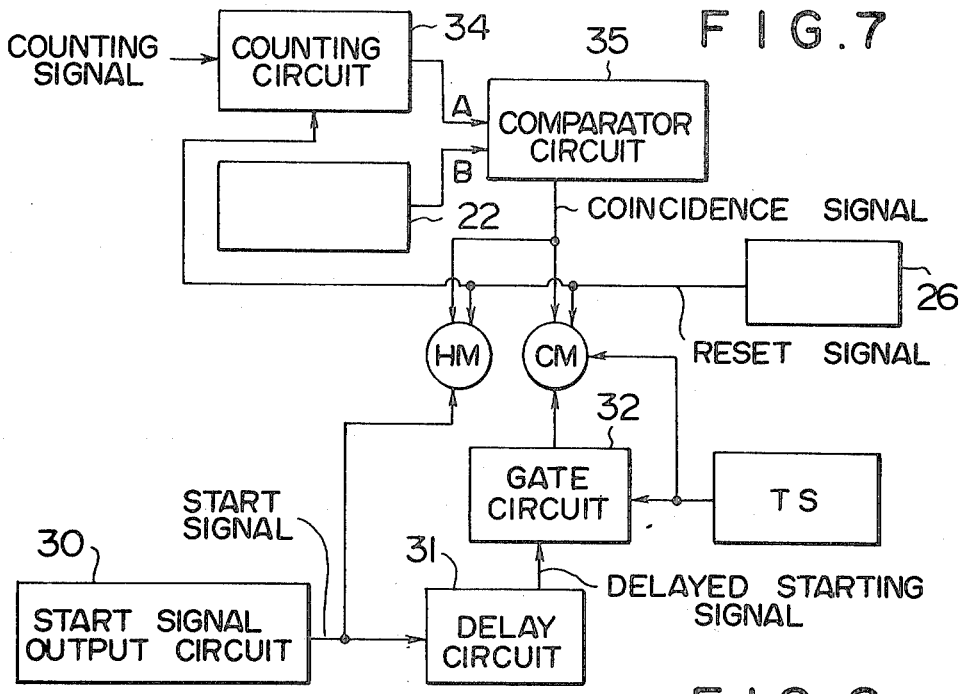
FIG. 7 is a block diagram showing the control circuit for controlling the sound-proof covers of the second embodiment according to the invention.

Referring now to FIGS. 3 and 7, the second embodiment of the invention will be described. As shown in FIG. 3, in the second embodiment, touch switches TS are formed respectively on the edge faces 20A and 20B of the sound-proof covers 6A and 6B. In detail, strips 37*a* and 37*b* of electrically conductive material are applied on the edge face 20A of the sound-proof cover 6A such that these plates are insulated with each other. A touch switch TS is formed by connecting the plate 37*a* to a power source of proper voltage while grounding the plate 37*b*. Similarly, strips 37*a* and 37*b* are applied on the edge face 20B of the sound-proof cover 6B to form another touch switch TS. The outputs from these touch switches TS are passed to a gate circuit 32 and a cover motor CM. The construction of the circuit shown in FIG. 7 is the same as that shown in FIG. 6 except that the cover position sensor PS and the comparator circuit 33 are omitted, and the parts serving as the equivalent parts are denoted by the same reference numerals.

In this second embodiment, if a hand or like part of the operator touches either one of the touch switches formed respectively on the edge faces of the sound-proof covers 6A and 6B during the closing operation, the closing movements of the sound-proof covers 6A and 6B are stopped and then they begin to open. Specifically, when at least one of the touch switches TS is switched on, the gate circuit 32 is rendered inoperative by the thus generated on-signal to prevent the delayed starting signal from passing therethrough, whereby the obverse rotation of the cover motor CM is stopped and the cover motor CM begins to rotate in the reverse direction on receipt of the on-signal from the touch switch TS to open the sound-proof covers 6A and 6B.

Figure 4:
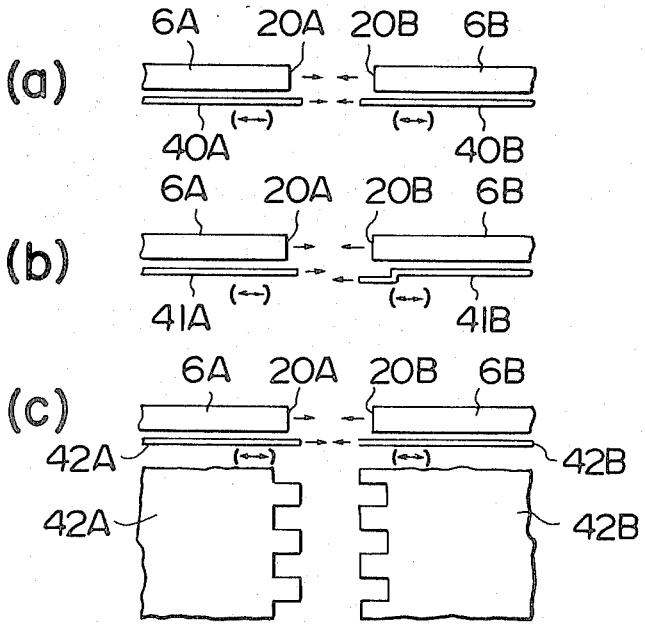
FIG. 4(*a*) to 4(*c*) are schematic views showing modifications of the sensor plate assembled with the sound-proof cover used in the third embodiment of the invention.

The third embodiment of the invention will be described hereinbelow with reference to FIG. 4. Three modifications of the third embodiment are shown in FIGS. 4(*a*), 4(*b*) and 4(*c*), respectively. As shown, in these modification, paired detector plates 40A and 40B, 41A and 41B and 42A and 42B are disposed at the inner sides of the sound-proof covers 6A and 6B such that they are slidable along the opening and closing direction of the sound-proof covers 6A and 6B. The opposing ends of the detector plates 40A and 40B, 41A and 41B and 42A and 42B project beyond the edge faces 20A and 20B of the sound-proof covers 6A and 6B. In the modification shown in FIG. 4(*a*), the fore end of the detector plate 40A abuts against the fore end of the detector plate 40B to be retracted when the sound-proof covers 6A and 6B are completely closed. In the modifications shown in FIGS. 4(*b*) and 4(*c*), the fore end portions of the paired detector plates are shaped so that they do not abut against each other. If a hand or like part of the operator is sandwiched in-between the sound-proof covers 6A and 6B, such the sandwiched hand engages with the paired detector plates 40A and 40B, 41A and 41B or 42A and 42B to retract them. The retracting movement of the detector plate is detected by a microswitch or a contactless switch, not shown, and the thus detected signal is delivered to a control circuit.

The circuit shown in FIG. 6 may be used as the control circuit to be combined with the modification of FIG. 4(*a*) for controlling the opening and closing movements of the sound-proof covers 6A and 6B. Instead of the output signal from the touch switch TS, the output signal from the microswitch or contactless switch for detecting the retracting movements of said detector plates 40A and 40B is put in the comparator circuit 33 shown in FIG. 6. By combining the modification shown in FIG. 4(*a*) with the circuit shown in FIG. 6, the cover motor CM can be rotated in the reverse direction to open the sound-proof covers 6A and 6B immediately after any obstacle, such as a hand of the operator, is sandwiched in-between the sound-proof covers 6A and 6B during the closing operation thereof.

The control circuit shown in FIG. 7 may be combined with either of the modifications of FIGS. 4(*b*) and 4(*c*) to control the opening and closing movements of the sound-proof covers 6A and 6B. In this combination, the output signal from said microswitch or contactless switch is fed to the circuit instead of the output signal from the touch switch TS shown in FIG. 7.

Figure 5:
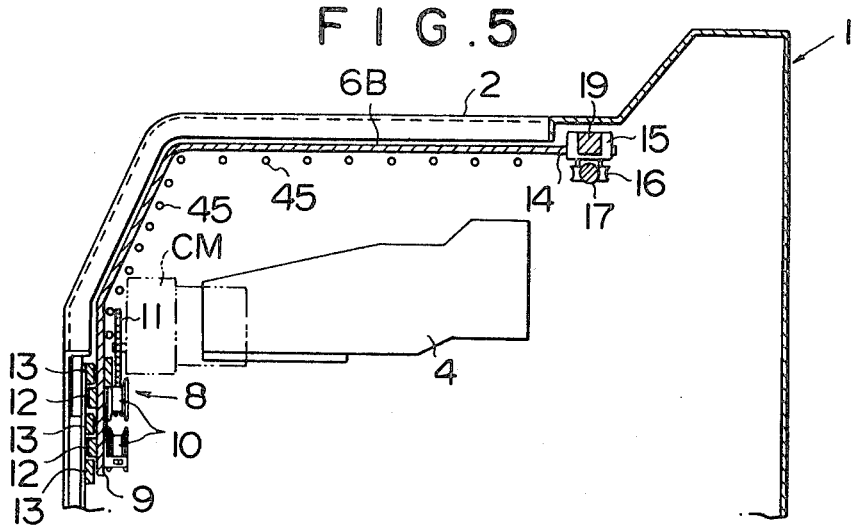
FIG. 5 is a view similar to FIG. 2 but showing the fourth embodiment of the invention.

The fourth embodiment of the invention will be described with reference to FIG. 5. In this embodiment, a plurality of photo-sensors 45 is arranged on the inside face of each of the sound-proof covers 20A and 20B at proper intervals in the vicinity of the edge face. The output signals from these photo-sensors are put in the gate circuit 32 and the cover motor CM instead of the output signal from the touch switch TS using the control circuit shown in FIG. 7. By combining the embodiment shown in FIG. 5 with the control circuit shown in FIG. 7, when any obstacle including a hand or other like part of the operator is sensed by the photo-sensors during the closing operation, the closing movements of the sound-proof covers 6A and 6B are stopped and then the covers are opened similarly as in the preceding embodiments.

Figure 8:
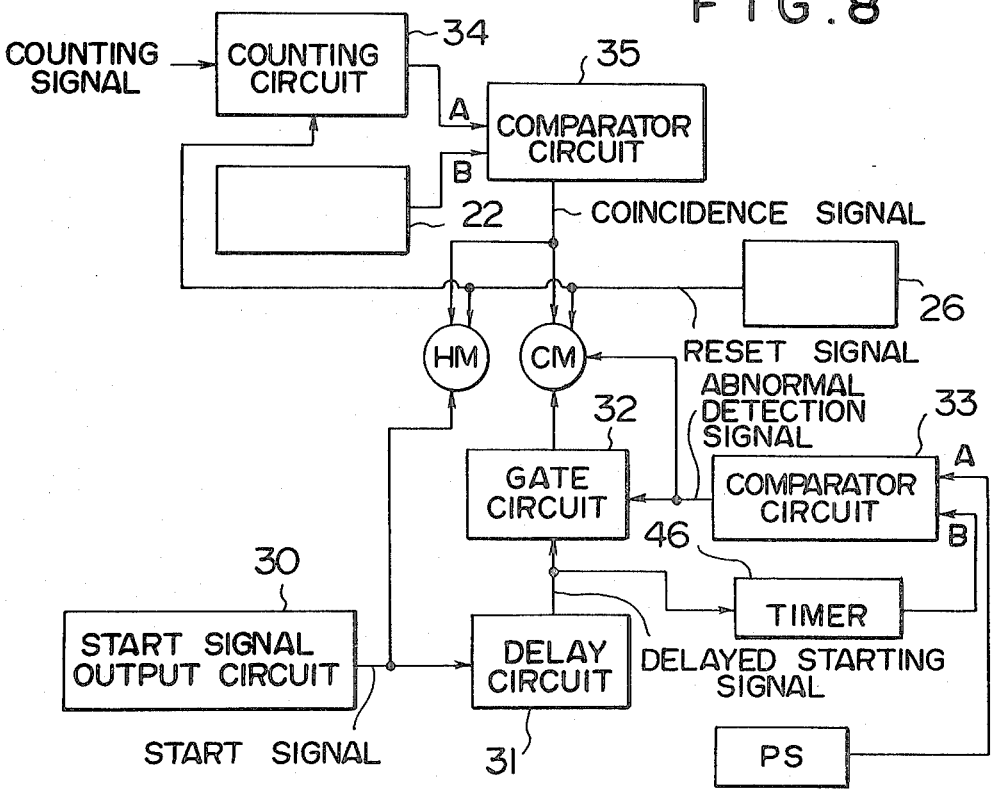
FIG. 8 is a block diagram showing the control circuit according to the fifth embodiment of the invention.

The fifth embodiment of the invention will be described with reference to FIG. 8. In this embodiment, the touch switches TS, the detector plates and photo-sensors are not used, not the control circuit shown in FIG. 8 is used to control the opening and closing movements of the sound-proof covers 6A and 6B. In detail, delayed starting signal from the delay circuit 31 is put in the gate circuit 32 and a timer 46. The timer 46 puts out an operation signal after a preset time period, for example after 3 seconds, after it receives the delayed starting signal. The operation signal from the timer 46 is put in the comparator circuit 33 in which the output signal from said cover position sensor PS is fed. If the comparator circuit 33 is not fed with the output signal from the cover position sensor PS even after the input of said operation signal is ceased, the comparator circuit 33 puts out an abnormal detection signal which is fed to the gate circuit 32 and the cover motor CM to render the gate circuit 32 inoperative for preventing the delayed starting signal from passing through the gate circuit 32 and concurrently to stop the obverse rotation of the cover motor CM. Subsequently, the cover motor CM is allowed to rotate in the reverse direction under the instruction by said abnormal detection signal. With this circuit construction, if the sound-proof covers 6A and 6B are not completely closed after the lapse of preset time period, for example after 3 seconds, and the output signal from the cover position sensor PS is not delivered to the comparator circuit 33, it is decided that any obstacle is sandwiched in-between the sound-proof covers 6A and 6B and thus the closing operations of the covers 6A and 6B are stopped followed by the opening operations thereof.

The control circuits shown in FIGS. 6 and 8 may be altered such that the detection signal or abnormal detection signal from the comparator circuit 33 is delivered only to the gate circuit 32 and not delivered to the cover motor CM. By the use of the thus altered circuit, the object of the present invention can be attained in such the way that the sound-proof covers 6A and 6B are stopped but not opened.

As described hereinabove, according to the present invention, the closing movements of the sound-proof covers are stopped if any obstacle is present in the vicinity of the covers or any obstacle is sandwiched in-between the covers when the sound-proof covers of the paper sheet counting machine are closed and the counting operation is stated. The device according to the invention has advantages that an obstacle, such as a hand or other part of the operator, is not sandwiched in-between the covers for a long period of time and that the motor driving the covers is not overloaded for a long period of time. Using the device of the invention, the closing movements of the sound-proof covers are stopped during the closing operation if it is found that the bundle of paper sheets is put on the holder imprecisely, so that the bundle can be reset in the right order so as to preclude the errorneous counting. According to the invention, there is provided a sound-proof device for use in the paper sheet counting machine, which is improved in safety, sound-proof property and accuracy in counting operation.

What is claimed is:

1. A paper sheet counting machine comprising:

a paper sheet counting mechanism including a holder for receiving a bundle of paper sheets, suction cylinders for turning over the paper sheets one by one, and a counting circuit for counting the number of paper sheets turned over by the suction cylinders;

a pair of double leaf type sound-proof covers made movable between an open position for providing easy access to said holder and a closed position at which said sound-proof covers extend above the section containing said paper sheet counting mechanism;

obstacle detecting means for detecting an obstacle which hinders the normal closing operation of said sound-proof covers to generate a signal;

a motor for closing said sound-proof covers after said holder receives said paper sheets and for opening the covers after the completion of the counting operation; and control means for controlling to actuate or stop said motor and including means for receiving said signal from said obstacle detecting means to stop said motor in response to said signal.

2. A paper sheet counting machine according to claim 1, wherein said sound-proof covers are provided with permanent magnets for ensuring the tight closure of the covers, the edge faces of said magnets being flush with the edge faces of said sound-proof covers.

3. A paper sheet counting machine according to claim 1 or 2, wherein said obstacle detecting means is a touch switch including an electrically conductive film applied over the edge face of one of said sound-proof covers and connected to a voltage source and an electrically conductive film applied over the edge face of the other of said sound-proof covers and connected to the earth, and wherein said control means is an electric circuit including a first comparator for comparing the actually counted number with the preset number to generate a signal for actuating to rotate said motor in the opening direction when the actually counted number is coincident with the preset number, a start signal output circuit for generating a signal for actuating to rotate a holder motor in the closing direction when a bundle of paper sheets to be counted is laid on said holder, a delay circuit for receiving the signal from said start signal output circuit to generate a delayed signal, a second comparator for receiving a signal from a cover position sensor and a signal from said touch switch to pass only off-signals therethrough, and a gate circuit for receiving said delayed signal and said off-signals passed through said second comparator to actuate said motor for closing said sound-proof covers.

4. A paper sheet counting machine according to claim 1 or 2, wherein said obstacle detecting means is a touch switch including electrically conductive strips applied on the edge face of each of the sound-proof covers so that they are electrically insulated with each other and extend substantially coextensive with the edge face of the sound-proof cover, and wherein said control means is an electric circuit including a comparator for comparing the actually counted number with the preset number to generate signal for actuating to rotate said motor in the opening direction when the actually counted number is coincident with the preset number, a start signal output circuit for generating a signal for actuating to rotate a holder motor in the closing direction when a bundle of paper sheets to be counted is laid on said holder, a delay circuit for receiving the signal from said start signal output circuit to generate a delayed signal, and a gate circuit for receiving said delayed signal and the signal from said touch switch, said gate circuit being rendered inoperative to prevent said delayed signal from passing therethrough when the signal from the touch switch is an on-signal.

5. A paper sheet counting machine according to claim 1 or 2, wherein said obstacle detecting means comprises a detecting plate extending beyond the edge face of each of the sound-proof covers to be retracted when it is engaged with any obstacle, and a switch energized by the retracting movement of said detecting plate for generating a signal.

6. A paper sheet counting machine according to claim 5, wherein said control means is an electric circuit including a first comparator for comparing the actually counted number with the preset number to generate a signal for actuating to rotate said motor in the opening direction when the actually counted number is coincident with the preset number, a start signal output circuit for generating a signal for actuating to rotate a holder motor in the closing direction when a bundle of paper sheets to be counted is laid on said holder, a delay circuit for receiving the signal from said start signal output circuit to generate a delayed signal, a second comparator for receiving a signal from a cover position sensor and said signal generated from said switch energized by the retracting movement of said detecting plate to pass only off-signals therethrough, and a gate circuit for receiving said delayed signal and said off-signals passed through said second comparator to actuate said motor for closing said sound-proof covers.

7. A paper sheet counting machine according to claim 5, wherein said control means is an electric circuit including a comparator for comparing the actually counted number with the preset number to generate a signal for actuating to rotate said motor in the opening direction when the actually counted number is coincident with the preset number, a start signal output circuit for generating a signal for actuating to rotate a holder motor in the closing direction when a bundle of paper sheets to be counted is put on said holder, a delay circuit for receiving the signal from said start signal output circuit to generate a delayed signal, and a gate circuit for receiving said delayed signal and the signal from said switch energized by the retracting movement of said detecting plate, said gate circuit being rendered inoperative to prevent said delayed signal from passing therethrough when the signal from said switch energized by retracting movement of said detecting plate is an on-signal.

8. A paper sheet counting machine according to claim 1 or 2, wherein said obstacle detecting means comprises a plurality of photo-sensors, and wherein said control means is an electric circuit including a comparator for comparing the actually counted number with the preset number to generate a signal for actuating to rotate said motor in the opening direction when the actually counted number is coincident with the preset number, a start signal output circuit for generating a signal for actuating to rotate a holder motor in the closing direction when a bundle of paper sheets to be counted is laid on said holder, a delay circuit for receiving the signal from said start signal output circuit to generate a delayed signal, and a gate circuit for receiving said delayed signal and signals from said plurality of photo-sensors, said gate circuit being rendered inoperative to prevent said delayed signal from passing therethrough when any one of said signals from said photo-sensors is an on-signal.

9. A paper sheet counting machine comprising:

a paper sheet counting mechanism including a holder for receiving a bundle of paper sheets, suction cylinders for turning over the paper sheets one by one and a counting circuit for counting the number of paper sheets turned over the suction cylinders;

a pair of double leaf type sound-proof covers made movable between an open position for providing easy access to said holder and a closed position at which said sound-proof covers extend above the section containing said paper sheet counting mechanism;

a motor for closing said sound-proof covers after said holder receives said paper sheets and for opening the covers after the completion of the counting operation; and control means for controlling to actuate or stop said motor and including a first comparator for comparing the actually counted number with a preset number to generate a signal for actuating to rotate said motor in the opening direction when the actually counted number is coincident with the preset number, a start signal output circuit for generating a signal for actuating to rotate a holder motor in the closing direction when a bundle of paper sheets to be counted is put on said holder, a delay circuit for receiving the signal from said start signal output circuit to generate a delayed signal, a timer for receiving said delayed signal to generate an operation signal after a preset time interval, a second comparator for receiving a signal from a cover position sensor and said operation signal from said timer to generate an abnormal detection signal if it is not fed with said signal from said cover position sensor even after said operation signal is received, and a gate circuit for receiving said delayed signal and a signal from said second comparator to actuate said motor for closing said sound-proof covers, said gate circuit being rendered inoperative when it receives said abnormal detection signal from said second comparator.

* * * * *